United States Patent [19]

Dezelan et al.

[11] 3,935,792

[45] Feb. 3, 1976

[54] PILOT PUMP BLEED CONTROL FOR EARTHMOVING SCRAPERS

[75] Inventors: Joseph E. Dezelan, Joliet; Henry J. Jessen, Wilmington, both of Ill.

[73] Assignee: Caterpillar Tractor Co., Peoria, Ill.

[22] Filed: June 26, 1974

[21] Appl. No.: 483,132

Related U.S. Application Data

[62] Division of Ser. No. 335,910, Feb. 26, 1973, Pat. No. 3,862,643.

[52] U.S. Cl. ..... 91/438; 60/403; 91/437; 91/461

[51] Int. Cl.[2] ..... F15B 11/08; F15B 13/042

[58] Field of Search ..... 91/438, 451, 461, 453, 91/304, 437; 60/403, 404

[56] References Cited

UNITED STATES PATENTS

| | | | |
|---|---|---|---|
| 3,160,174 | 12/1964 | Schmiel et al. | 137/625.63 |
| 3,366,016 | 1/1968 | Anderson | 91/438 |
| 3,515,032 | 6/1970 | Dezelan et al. | 91/51 |
| 3,620,129 | 11/1971 | Fruehauf | 91/461 X |

*Primary Examiner*—Irwin C. Cohen
*Attorney, Agent, or Firm*—Phillips, Moore, Weissenberger Lempio & Strabala

[57] ABSTRACT

In an earthmoving scraper a low volume, low pressure, pilot pump supplies fluid pressure to a pilot control valve which routes this fluid through bleed lines to a remote scraper control valve that operates the bowl jacks on the scraper from a separate source of pressurized hydraulic fluid. By manually varying the bleed rates of the output of the pilot pump with the spool of the pilot valve, proportion actuation of the control valve can be obtained through differential pressures in the bleed lines connecting it to the pilot valve. A safety valve connected in the bowl carry circuit supplies an alternate source of fluid pressure to the pilot valve if the pilot pump fails, ensuring positive fail-safe operation of the system.

3 Claims, 2 Drawing Figures

N
R
L
L'
11
12
14
15
13
10
37
30
29
26
29
37
27
24
24
28
70
31
39
38
35
25
32
39
38
38
38
16
17
19
P
V
REL
20
65
64
"A" SIDE
"B" SIDE
60
63
33
62
33
36
45
40
P
34
45
41
42
61
53
53
50
54
52
47
44
43
54
51
47
46

PILOT PUMP BLEED CONTROL FOR EARTHMOVING SCRAPERS

This is a division, of Ser. No. 335,910, filed Feb. 26, 1973 now U.S. Pat. No. 3,862,643.

BACKGROUND OF THE INVENTION

In earthmoving scrapers a number of the implement components on the scraper portion must be controlled from the tractor portion by the operator. As a result, numerous high pressure hydraulic hoses often must cross the articulated hitch between the tractor and scraper portions, or an alternate arrangement selected, involving locating the control valves on the scraper portion and operating them by remote control systems.

While such an alternate arrangement has many advantages, it does require a safe, reliable, positive acting remote control system to operate the control valves on the scraper portion, as the operator does not have any direct physical access to the main control valves. Because of these requirements, pilot-operated control systems using positive bleed arrangements have been used, such as disclosed in U.S. Pat. No. 3,515,032 which issued to J. E. Dezelan et al. on June 2, 1970. Also see U.S. Pat. No. 3,048,978 which issued to Hare on Aug. 14, 1962 and U.S. Pat. No. 3,160,174 issued to Schmiel on Dec. 8, 1964 and U.S. Pat. No. 3,220,318 issued to McGuire on Nov. 30, 1965. The current invention is related to a bleed control system similar to the one disclosed in some of these patents.

One of the principal objectives of this invention is to provide a pilot control system for scrapers that is suitable for operating open center control valves, so needless horsepower loss will not occur by pumping large volumes of hydraulic fluid at high pressures over relief valves.

Another object is the provision of a pilot-operated system which includes fail-safe features for earthmoving scrapers.

SUMMARY OF THE INVENTION

The above objects and others can be accomplished with a pilot bleed control system which includes a pilot pump with its outlet connected to a pilot valve having a pilot spool with metering slots so it is operable to develop two equal pressures within the pilot valve body and having two conduits communicating these equal pressures to reaction chambers associated with opposite ends of a control spool of a remote open center control valve with bleed passages in the opposite ends of the control valve spool whereby positive bleeds from the pilot valve to the control valve are established and shifting of the pilot spool will cause the control valve spool to shift proportionally due to change in the pressures in the two conduits resulting from variations in the flows across the several metering slots in the pilot valve. A safety valve incorporated in a hydraulic circuit underload can be employed to provide an emergency source of pressurized fluid if the pilot pump fails by using the pilot pump output pressure to operate the valve and connecting it to the pilot valve.

BRIEF DESCRIPTION OF THE DRAWINGS

The instant invention will be better understood when the specification is read in conjunction with the accompanying drawings wherein.

DESCRIPTION OF THE PREFERRED EMBODIMENT

Figure 1:
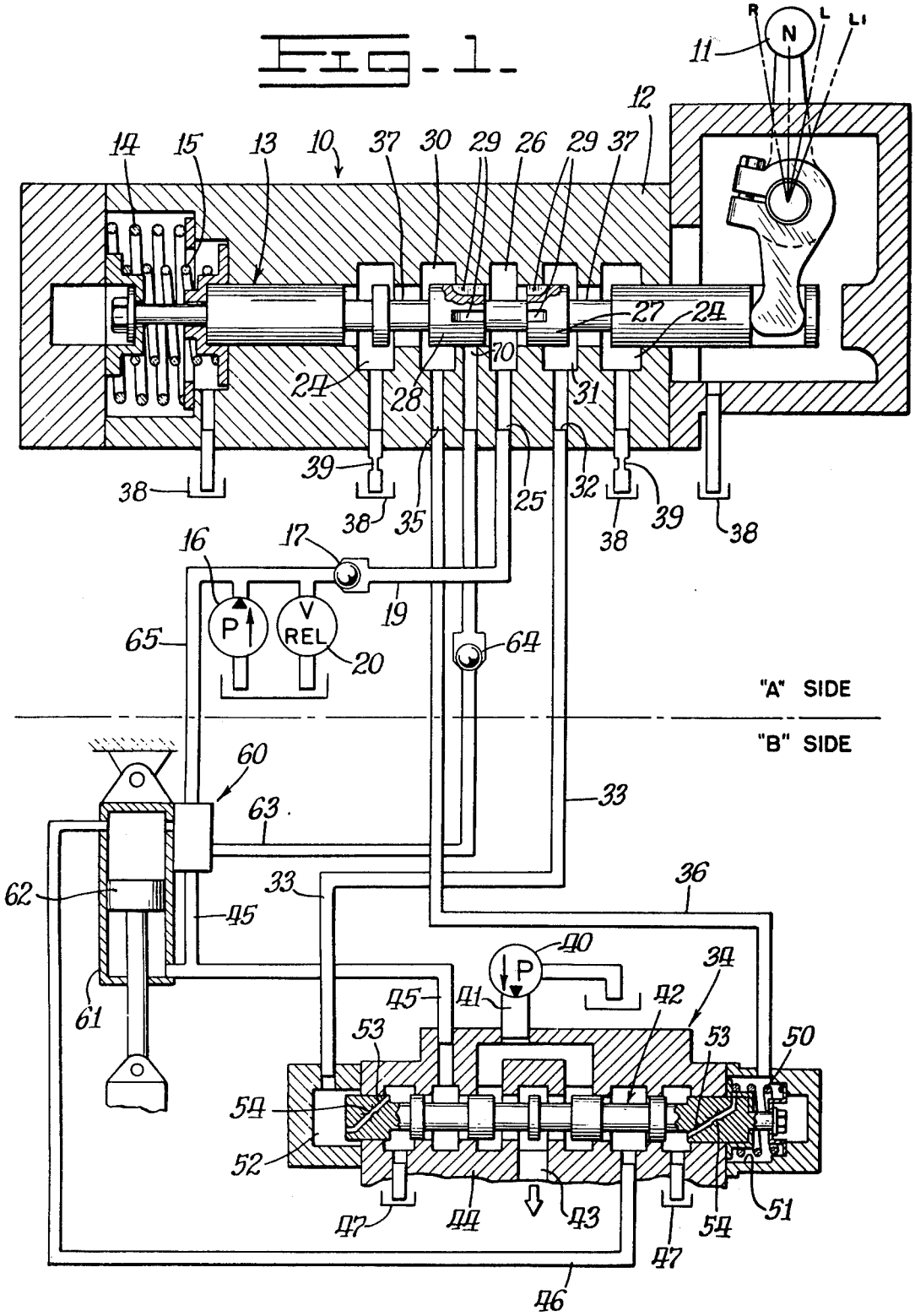
FIG. 1 is a schematic of the pilot control circuit with the details of the valve components illustrated in section.

In FIG. 1 a broken line separates the several components of the system and those on the A side of the line are mounted on the tractor portion while those on the B side of the line are typically located on the scraper portion. Flexible connections for the lines and conduits which are utilized across the hitch are not shown. Pilot valve 10, on the tractor portion, includes a manual-operated control handle 11 pivotally mounted at one end of the valve body 12 and connected so as the handle is rocked on its pivot it will reciprocate a pilot valve spool 13, mounted in the valve body. Centering springs 14 and 15 with associated washer seats are connected to the opposite end of the pilot spool and are operable to return this spool and the control handle to neutral (indicated by N) when the handle is released.

Normally, pressurized fluid is supplied to the pilot valve 10 by a pilot pump 16 via check valve 17 and conduit 19. The output of the pilot pump is only several gallons per minute and is relieved at approximately 500 psi by relief valve 20. Through the use of the pilot pump, the higher volume implement pump which operates at higher pressures does not needlessly consume horsepower until an implement circuit is operated.

The output of the pilot pump via conduit 19 enters port 25 in the pilot valve body 12 which communicates with an inlet groove 26, closed on opposite sides by pilot spool lands 27 and 28. Each of these pilot spool lands includes a plurality of metering slots 29 which bleed pressurized hydraulic fluid from the inlet groove to separate outlet grooves, 30 and 31, on opposite sides of the inlet groove. As the bleed rate to each outlet groove is nearly identical, approximately the same pressure will be developed in each outlet groove when the pilot valve spool is in a neutral position and similar restrictions on the egress of fluid from the outlet grooves are employed.

Outlet groove 31 includes a port 32 which is connected across the articulated hitch (not shown) via conduit 33 to a control valve 34 on the scraper portion, while outlet groove 30 which includes port 35 is similarly connected to the control valve through conduit 36. Thus, with the pilot valve spool in neutral fluid pressure can be transmitted to the control valve via these two conduits. To ensure a positive pressure in each of these conduits, each outlet groove is in communication with a separate drain groove 24 across associated recesses 37 in the pilot valve spool when it is in the neutral position and each of these drain grooves is respectively vented to reservoir 38 via their own separate orifice 39. With the metering slots 29 arranged to deliver more fluid capacity than the orifices can pass, a positive pressure in conduits 33 and 36 is ensured and, as indicated, their respective pressures are equal when the pilot valve spool is in a neutral position.

On the scraper portion the open center type control valve 34 is connected directly to the higher pressure implement pump 40 via line 41, but it should be understood this pump could also be located on the tractor portion with a high pressure line connecting it to the control valve. Control valve spool 42 in the control valve, when shifted will close drain port 43 in the control valve body 44 and cause the implement pump to pressurize either line 45 or 46 (depending on the direction of spool shift) while connecting the unpressurized line to drain or reservoir 47. Conventional lands and grooves are used in the control valve spool and control valve body to effect this operation. Thus, the main or implement pump is not "working" (consuming power) when the implement circuits are not in use.

A heavy duty centering spring 50 is connected between the control valve body 44 and one end of the control valve spool 42 and with the accompanying washer-like spring seats, returns the control valve spool to a neutral position when a force displacing it in either direction is removed. In the instant invention, differential pressures in lines 33 and 36 provide the displacing force. This is provided by forming separate chambers 51 and 52 respectively at opposite ends of the control valve spool and connecting conduit 33 to chamber 52 and conducting conduit 36 with chamber 51. Within each chamber the associated end of the control valve spool projecting thereinto provides a reaction surface for the pressure within its associated chamber, allowing differential pressures at opposite ends of the spool to shift it against the centering spring force. In order to provide a positive and continuous bleed each reaction surface includes a drain passage 53, with an included orifice 54 that bleeds pressure from its associated chambers slowly to drain or the reservoir 47. Thus, with the valve positions shown in the drawings, a continuous bleed occurs, purging conduit 33 and 36 of cold viscous hydraulic fluid, as well as on trapped air.

With both pumps running when the operator shifts handle 11 to the raised R position, the fluid pressure bleed to outlet groove 30 will be interrupted while the fluid flow to outlet groove 31 will be increased. As a result, the pressure communicated to chamber 52 will increase with respect to chamber 51 causing the control valve spool 42 to move into the latter chamber and couple implement pump 40 with line 45. Due to the presence of the metering slots in the pilot valve spool 13, the resulting differential pressure in the two chambers can be proportionally varied, giving full control of the control valve over a wide range of operating rates, when using a smaller, more easily manipulated pilot control valve. Obviously, when the pressure equalizes in the several chambers the centering spring 50 will return the control valve spool to neutral. The operation is identical when the control handle 11 is placed in the lower or L-position, except that line 46 is pressurized instead of line 45, the latter then being vented to reservoir.

Figure 2:
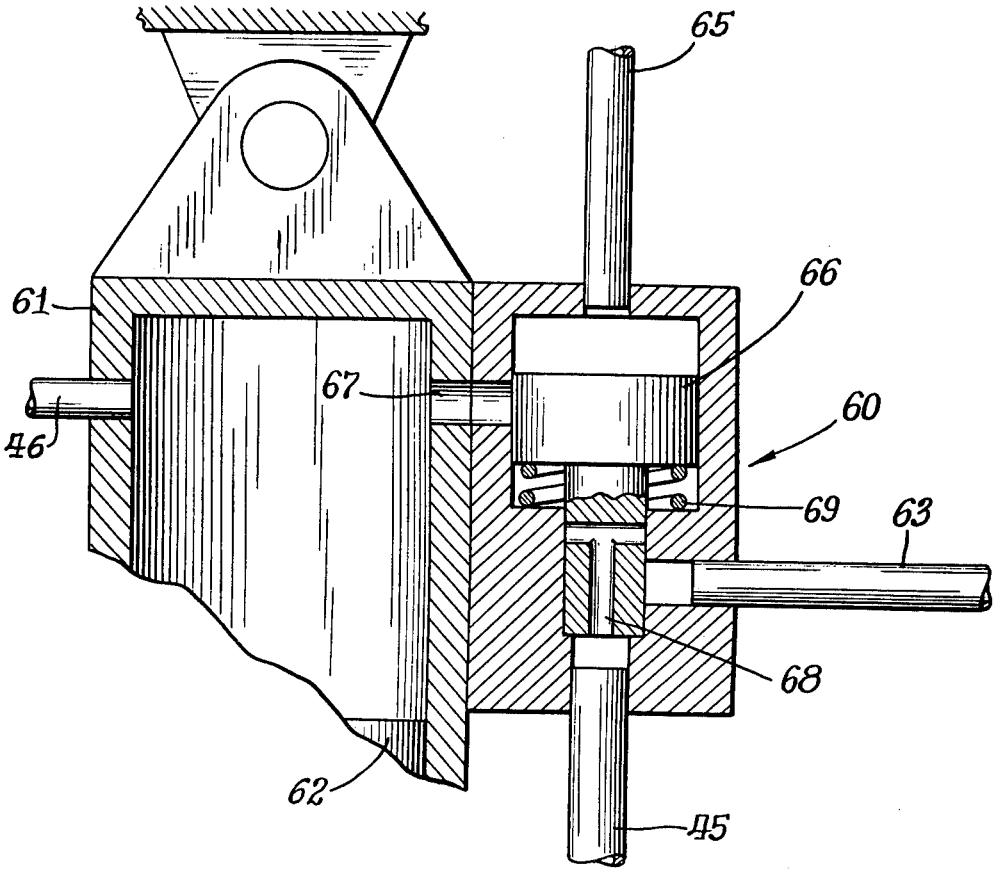
FIG. 2 is an enlarged section of the safety valve utilized to ensure fail-safe operation of the pilot control system, with parts broken away.

To insure fail-safe operation a special safety valve 60 is employed in the bowl carry circuit which includes lines 45 and 46 connected to bowl lift jack 61 (only jack being shown). This safety-valve, better shown in FIG. 2, is connected to line 45, which communicates with the rod end of jack 61, so if the bowl is off the ground, its weight and the weight of its contents will be supported by jack piston 62, ensuring a positive pressure in line 45. The safety valve also is connected to the pilot valve via line 63 and check valve 64, as shown in FIG. 1.

A conduit 65 connects the output of the pilot pump 16 to the safety valve 60 and, as can be seen in FIG. 2, the pressure from the pilot acts on the top of valve piston 66 to hold the safety valve in the "off" position so that pressure in line 45 cannot communicate with line 63 or to port 67, above the jack piston 62, through bleed passage 68. If pilot pump pressure is lost, the spring 69 and fluid pressure in line 45 will move the valve piston to open port 67 and open communication between line 45 and line 63. As a result, the bowl will very slowly lower due to flow through the bleed passage 68 to port 67.

However, it is also necessary that the operator have the ability to lower the bowl quickly, since this can stop the vehicle in emergency situations. By utilizing the pressure in line 63 and the pilot valve, this can be accomplished if the operator moves the control handle 11 to the emergency lower or $L_1$ position. When this is done spool land 28, which normally closes port 70, opens this port allowing fluid pressure from line 63 to communicate with outlet groove 30 via the inlet groove. As can be seen, this port is normally closed off from the inlet groove by this land in the L position but opens in the $L_1$ position. As a result, conduit 36 will be pressurized with the bowl carry pressure and shift the control valve spool 42 to lower the bowl whether or not either pump is operational as the weight of the bowl will cause it to lower without pump pressure. Check valve 17 prevents loss of the bowl carry pressure through the pilot pump circuit.

We claim:

1. In a pilot system including a hydraulic actuator controlled by an adjacent control valve, having a source of fluid pressure connected thereto, the latter valve being operated through a pilot control valve having its own pilot pump providing a source of fluid pressure for operating the control valve, a safety control system employing fluid pressure from said hydraulic actuator under load for emergency operations of the control valve comprising:

a safety valve body having a stepped axial bore therein;

a stepped spool means reciprocally mounted in said bore forming at least three separate chambers therein, including a first chamber having the largest spool reaction surface, a second chamber having a smaller spool reaction surface and a third chamber having the smallest spool reaction surface;

a pilot pump port in said valve body communicating with said first chamber with conduit means connecting said pilot pump port with the fluid pressure from said pilot pump;

an inlet port in said valve body communicating with said third chamber with conduit means connecting it with a side of said actuator under load;

a spool closable cylinder port in said valve body with conduit means connecting it to the opposite side of said actuator under load, said cylinder intermediate port having fluid communication with said second chamber when said spool moves into said first chamber;

a spool closable valve port in said valve body with conduit means connecting it to the fluid supply port of the pilot valve, said valve port having fluid communication with said third chamber when said spool moves into said first chamber; and a spool closable orifice means in said spool means having fluid communication with said third chamber and also with said second chamber when said spool moves into said first chamber, thereby providing restricted communication between said second and third chambers when pilot pump fluid pressure is lost, allowing said spool to move into said first chamber, whereby fluid pressure will be provided to the fluid supply port of said pilot valve for operating the control valve when pilot pump pressure is lost and the actuator under pressure will slowly bleed down due to the transfer of hydraulic fluid through the restricted orifice from the loaded side of the actuator to the unloaded side of the actuator.

2. The system defined in claim 1 wherein biasing means are included in the valve body operable to urge said spool into the first chamber when fluid pump pressure is lost.

3. The system defined in claim 1 wherein a one-way check valve is included between the pilot pump and the pilot control valve operable to prevent venting of hydraulic pressure from the actuator through a non-operable pilot pump.

* * * * *